US006615551B2

(12) United States Patent
Chesser et al.

(10) Patent No.: US 6,615,551 B2
(45) Date of Patent: Sep. 9, 2003

(54) MEDIA WALL

(75) Inventors: Linda Elizabeth Chesser, East Grand Rapids, MI (US); William Frederick Schacht, East Grand Rapids, MI (US); Robert J. Bockheim, Wyoming, MI (US); Scott E. Carpenter, Grand Rapids, MI (US); Michael G. Fedrigo, Grand Rapids, MI (US)

(73) Assignee: Nucraft Furniture Company, Comstock Park, MI (US)

( * ) Notice: Subject to any disclaimer, the term of this patent is extended or adjusted under 35 U.S.C. 154(b) by 0 days.

(21) Appl. No.: 09/881,521

(22) Filed: Jun. 14, 2001

(65) Prior Publication Data

US 2003/0000153 A1 Jan. 2, 2003

(51) Int. Cl.[7] ..... E04F 19/00

(52) U.S. Cl. ..... 52/36.4; 52/29; 52/36.5; 52/71; 52/65; 160/135

(58) Field of Search ..... 52/29, 36.4, 71, 52/36.5, 36.6, 65, 36.1, 235; 248/243, 239, 241, 214, 215, 284; 160/135

(56) References Cited

U.S. PATENT DOCUMENTS

| | | | | |
|---|---|---|---|---|
| 3,078,133 A | | 2/1963 | Schauer | |
| 4,559,410 A | | 12/1985 | Hostetter | |
| 5,130,494 A | | 7/1992 | Simonton et al. | |
| 5,172,529 A | | 12/1992 | Van De Riet | |
| 5,346,296 A | | 9/1994 | Kelley | |
| 5,558,418 A | | 9/1996 | Lambright et al. | |
| 5,584,546 A | | 12/1996 | Gurin et al. | |
| 5,778,612 A | * | 7/1998 | Kissinger et al. | 52/220.1 |
| 5,860,713 A | | 1/1999 | Richardson | |
| 5,878,673 A | | 3/1999 | Kramer et al. | |
| 5,964,164 A | * | 10/1999 | Lechman | 108/109 |
| 6,070,956 A | | 6/2000 | Yates | |
| 6,101,773 A | | 8/2000 | Chau et al. | |
| 6,158,829 A | | 12/2000 | Nielsen | |
| 6,241,329 B1 | | 6/2001 | Nielsen | |
| 6,272,795 B1 | * | 8/2001 | Brauning | 52/36.1 |
| 6,402,109 B1 | * | 6/2002 | Dittmer | 248/243 |

OTHER PUBLICATIONS

Exhibit A is a catalog excerpt of an audio–visual cabinet that was on sale prior to the filing date of the above–identified patent application.

Exhibit B comprises several pages of catalog excerpts of a media cabinet that was on sale prior to the filing date of the above–identified patent application.

* cited by examiner

*Primary Examiner*—Carl D. Friedman
*Assistant Examiner*—Nahid Amiri
(74) *Attorney, Agent, or Firm*—Van Dyke, Gardner, Linn & Burkhart, LLP

(57) ABSTRACT

A media wall for supporting various types of media, such as plasma screen or flat screen television sets, as well as other types of thin media, includes an upright vertical wall to which the media is mounted. The wall may include a pair of sidewalls mounted to a back face of the vertical wall, as well as a shelf extending forwardly from the vertical wall. At least one aperture may be included for enabling power or data cables to be inserted through the wall from the front to the back. A video camera support may be mounted on the vertical wall. The wall may be pivotable about a vertical axis to allow easy access to the rear of the wall for setting up and adjusting the electrical cabling used to support the media.

47 Claims, 7 Drawing Sheets

MEDIA WALL

BACKGROUND OF THE INVENTION

This invention relates generally to furniture, and in particular to pieces of furniture that support electrical or electronic equipment, such as plasma screen or flat screen television sets, computer monitors, and other devices.

As technology has advanced, more and more television sets and computer monitors are being manufactured that are substantially thinner than prior television sets and computer monitors. Such thin screen technology includes plasma screen televisions, flat screen displays for both computers and televisions, as well as other technologies. As these technologies have become more prevalent, the need for furniture specifically adapted to support these thin screen media has grown. Existing furniture has generally been ill suited to support these thin screen media because of the very thinness of the media.

For example, plasma screen televisions may have a thickness of only several inches but a height and width of several feet. This shape makes these screens very prone to tipping if they are not properly secured. Prior art television display cabinets often do not have the means to prevent such tipping, and also tend to have shelf depths that are far greater than is necessary to accommodate plasma screen televisions. Furthermore, the height and width of plasma screen televisions is generally greater than that of standard television sets. This further renders prior art television cabinets incapable of supporting plasma screen televisions.

Apart from the inability of prior art furniture to easily accommodate thin display media, prior art furniture has also suffered from further disadvantages. Specifically, prior art furniture that is designed to support electrical or electronic equipment has generally been poor at facilitating the installation and any modifications that are made to the equipment supported on the furniture. As one example, prior art television stands generally include a back wall with one or more relatively small holes through which various cords associated with the television are threaded. These cords typically include at least a power cord and a cord for communicating with a VCR or DVD player, or other device supported on the stand. When installing these and other electronic devices on the stand, the cords often have to be threaded through these holes while the stand is positioned up against a wall. This substantially prevents access to the rear of the stand and makes the installation or modification of the cord connections difficult. Further, after the stand has been set up in its desired location, gaining access to power outlets or communications ports located behind the television stand is exceedingly difficult. The need can therefore be seen for a type of furniture that overcomes these difficulties and allows easy set-up and modification of electronic components and their wire connections. The need can also be seen for a type of furniture that can accommodate thin display media.

SUMMARY OF THE INVENTION

Accordingly, the present invention provides a new type of furniture referred to herein as a media wall. The media wall is specially adapted to facilitate the installation and set-up of electronic components, as well as any changes made to either the electrical components or the wires connected to the components. The media wall is also specially adapted to support thin display media. The media wall further allows easy access to be obtained to power and other types of communication ports. Still further, the media wall accomplishes all of these functions in an aesthetically pleasing manner.

A media wall according to one aspect of the present invention includes an upright vertical wall having a front face and a back face. At least one aperture is defined in the wall and is adapted to allow at least one cable to extend from the front face to the back face of the wall. A support is also provided and is adapted to be affixed to a stationary structure. A hinge is attached to the support and the wall, and allows the wall to pivot about a vertical axis.

A media wall according to another aspect of the present invention includes an upright vertical wall with a front and back face. At least one shelf is attached to, and extends forwardly from, the upright wall. A support is provided and adapted to be fixed to a stationary structure. A hinge is attached to the support and the wall and is arranged to allow the wall to pivot about a vertical axis.

A media wall according to still another aspect of the present invention includes an upright, vertical wall having a front and back face. A pair of sidewalls are attached to the back face of the upright wall. At least one shelf is attached to the front face of the wall and extends forwardly therefrom. A support is affixed to the wall and is adapted to be attached to a stationary structure such that the support secures the wall in a fixed position when the support is affixed to a stationary structure.

In still other aspects of the invention, the media wall may include an adjustable video camera support mounted on the front face of the wall. One or more drawers may also be included on the wall for storage. A conduit, such as a cable trough or other structure, may be provided on the back face of the wall for holding any cable(s) used to operate the electronic equipment supported on the media wall. The sidewalls may also include data, telephone, and power ports to allow other electrical devices to both draw power through the media wall and to communicate with the electrical devices supported on the media wall. The shelf may include a pivotable panel disposed at the rear end of the shelf which pivots to allow greater access between the front and back faces of the media wall.

The media wall of the present invention provides a convenient and aesthetically pleasing structure for supporting thin display media, as well as video cameras and other related electronic devices. The media wall conceals the electrical cabling necessary to operate such equipment while still allowing easy access to such equipment for maintenance and modification purposes. The media wall provides these advantages while taking up only a minimum amount of space. These and other benefits of the present invention will be apparent to one skilled in the art in light of the following specification when read in conjunction with the accompanying drawings.

DETAILED DESCRIPTION OF THE PREFERRED EMBODIMENTS

Figure 1:
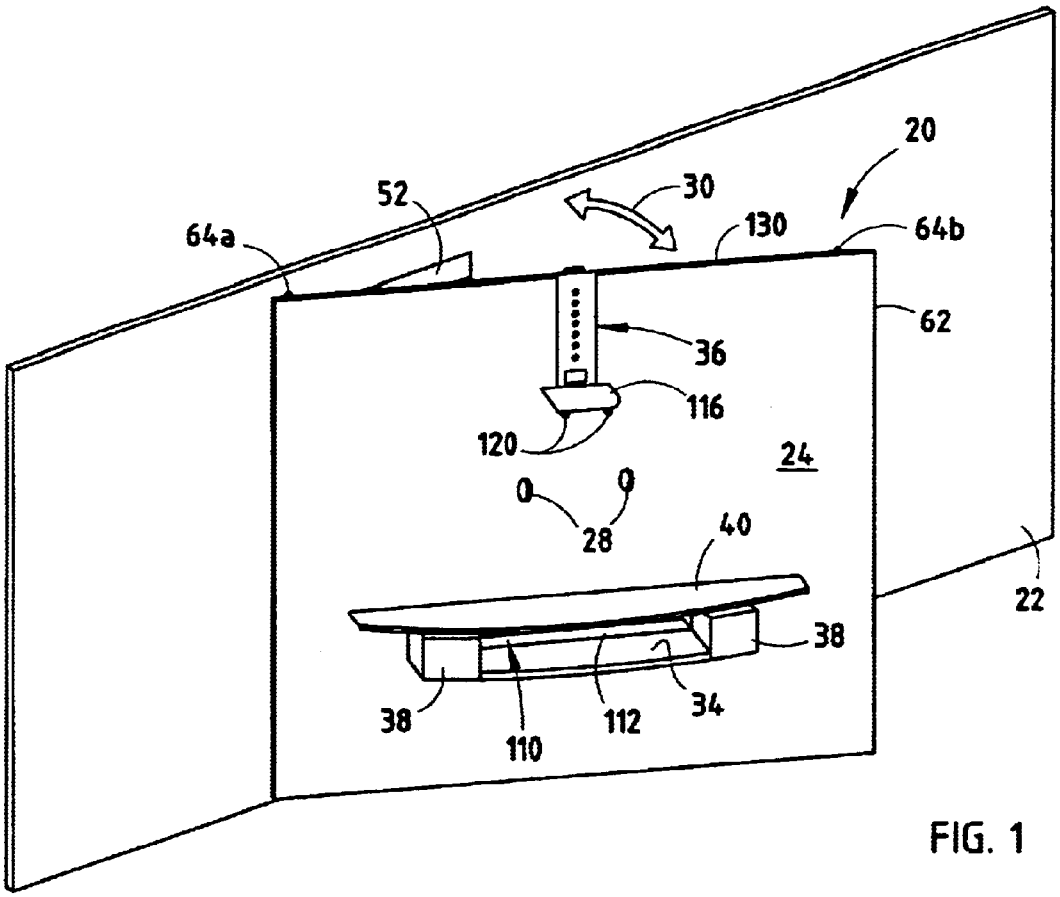
FIG. 1 is a perspective view of a media wall according to one embodiment of the present invention.

The present invention will now be described with reference to the accompanying drawings wherein like reference numerals correspond to like elements in the several drawings. A media wall 20 according to one aspect of the present invention is depicted in FIG. 1. Media wall 20 is shown positioned in front of a building or structural wall 22 which may be a permanent or semi-permanent wall that one would find in an office or a residential home. Structural wall 22 forms no part of the present invention. In the illustrated embodiment, media wall 20 is constructed to be pivotable with respect to structural wall 22, as indicated by arrow 30, in order to allow easy access to the structures located between media wall 20 and structural wall 22. Media wall 20 includes a front face 24 on which one or more plasma screen televisions 26 or other types of media display devices may be mounted (see FIGS. 8 and 9). Such mounting may occur at any desirable location along front face 24.

Media wall 20 may include one or more apertures 28 which allow cords to be passed from the devices mounted on front face 24 to a back face 32 (FIG. 1). A shelf 34 may also be provided on front face 24 of media wall 20 to support additional electronic components, such as DVD players, VCRs, CD players, or other equipment. An opening behind shelf 34 is provided to allow the cables from these devices to be inserted to the back side of media wall 20. As will be explained in more detail below, outlets may be provided within media wall 20 adjacent shelf 34 and in other areas which allow the electronic devices to plug directly into media wall 20 for power. The wiring and cords necessary to implement the particular media devices which a user has chosen are all easily implemented or modified by way of the pivoting action of media wall 20, which allows easy access to back face 32.

A video camera support 36 is mounted on media wall 20 to support a video camera which may be used to implement teleconference calls. Video camera support 36 may be both horizontally and vertically adjustable, as described more fully herein. Video camera support 36 may, of course, be used to support devices other than video cameras. A pair of drawers 38 are also included in media wall 20 on opposite sides of shelf 34 to provide storage space for items associated with the mounted electronic components, as well as other items. Drawers 38 are slidable forwardly from media wall 20 such that they can be accessed by a user standing in front of media wall 20. A second shelf 40 above first shelf 34 is also provided and creates additional space for supporting equipment that may be desirably supported on media wall 20.

Figure 2:
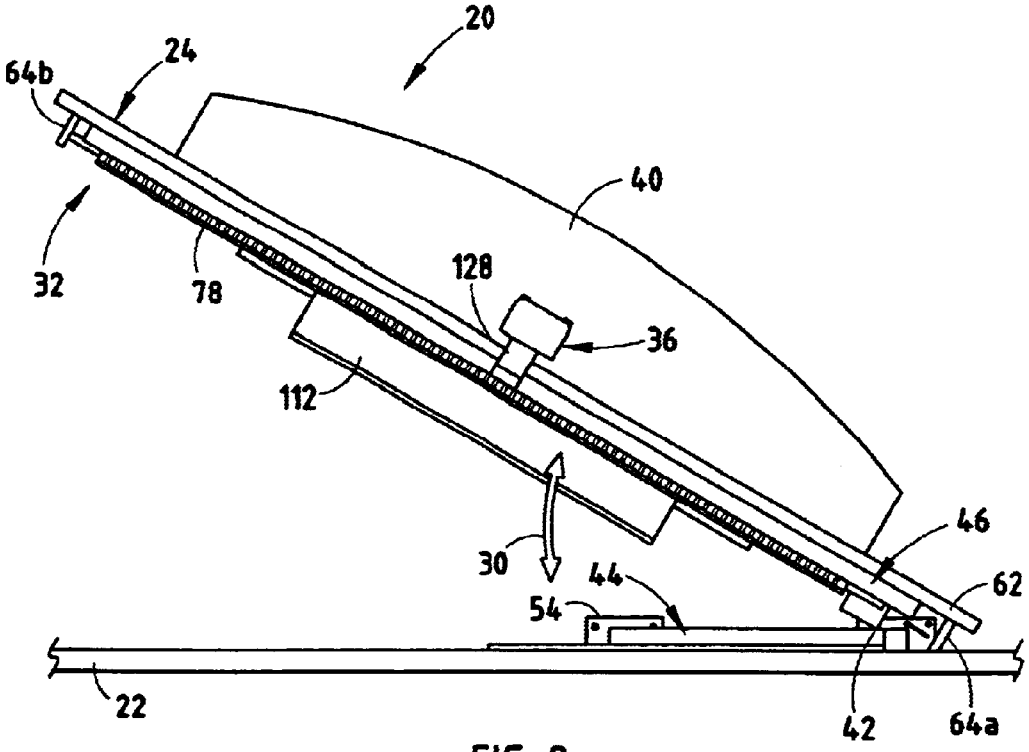
FIG. 2 is a plan view of the media wall of FIG. 1.

As illustrated in FIG. 2, media wall 20 is pivotable about a vertical axis 42 positioned adjacent one side of media wall 20. The pivoting of media wall 20 occurs by way of a hinge or other suitable device attached between a stationary support 44 and a frame 46 of media wall 20. Stationary support 44 supports frame 46 and all of its attachments as it pivots. Stationary support 44 includes a straight section 48, a knee 50, and a top support 52. A mounting plate 54 is attached to the bottom of both straight section 48 and knee 50. Mounting plates 54 each include a plurality of fastener holes for use with screws, bolts, etc. to firmly mount stationary support 44 to the floor. Top support 52 is mounted to structural wall 22 by way of any suitable fasteners, such as screws, bolts, nails, or other types of fasteners. In order to ensure a proper mounting, the fasteners inserted through top support 52 should be inserted into one or more studs in stationary wall 22. Stationary support 44 is preferably made from any suitably strong metal, such as steel, although other materials can be used. It will be understood by one skilled in the art that the structure of stationary support 44 can vary considerably from that described herein and depicted in the attached drawings without departing from the scope of the invention.

Frame 46 generally has a rectangular shape that matches the shape of media wall 20. Frame 46 includes a top section 56, a bottom section 58, and a pair of side sections 60, which are all secured together and designed to support the weight of media wall 20. While frame 46 may be made of any suitably strong material, it has been found that aluminum provides sufficient strength to support media wall 20 while still being relatively lightweight. Frame 46 generally extends about the periphery of a main wall 62 and is secured thereto by way of any suitable fasteners, such as screws, bolts, nails, or others. Such fasteners are used in sufficient number and inserted into main wall 62 to a sufficient depth to firmly secure main wall 62 and frame 46 together without having any of the fasteners visible on front face 24 of main wall 62.

A pair of sidewalls 64*a* and *b* are attached to back face 32 of main wall 62. Sidewalls 64*a* and *b* extend rearwardly from back face 32 a relatively small distance, such as six inches or less, although greater distances are contemplated within the scope of the invention. At least one sidewall 64 preferably includes a connection panel 66 (FIGS. 3–4) disposed within the sidewall. In the most preferred embodiment, each sidewall 64*a* and *b* includes a connection panel 66*a* and *b*. Connection panels 66 provides an interface for a variety of electrical and electronic cords or cables. For example, connection panel 66 may include a power outlet 68 (FIG. 4) into which electrical or electronic devices may be plugged in order to receive electrical power. Connection panel 66 may also include a telephone jack 70 into which a telephone or other device that uses telephonic communications may be inserted. Connection panel 66 may still further include a video jack 72 and a data jack 74. Video jack 72 allows a cable over which video signals are transmitted, such as one used in connection with a VCR or DVD player, to be inserted into connection panel 66. Data jack 74 allows a cable over which electronic data is transmitted, such as an Internet or other network connection, to be inserted into connection panel 66. Telephone, video, and data jacks 70–74 allow one or more telephones, computers, or other electronic equipment to be plugged into connection panel 66 on a sidewall 64 and thereby be able to communicate with one or more electronic devices mounted on media wall 20, as well as external networks, as will be described in more detail below.

Figure 3:
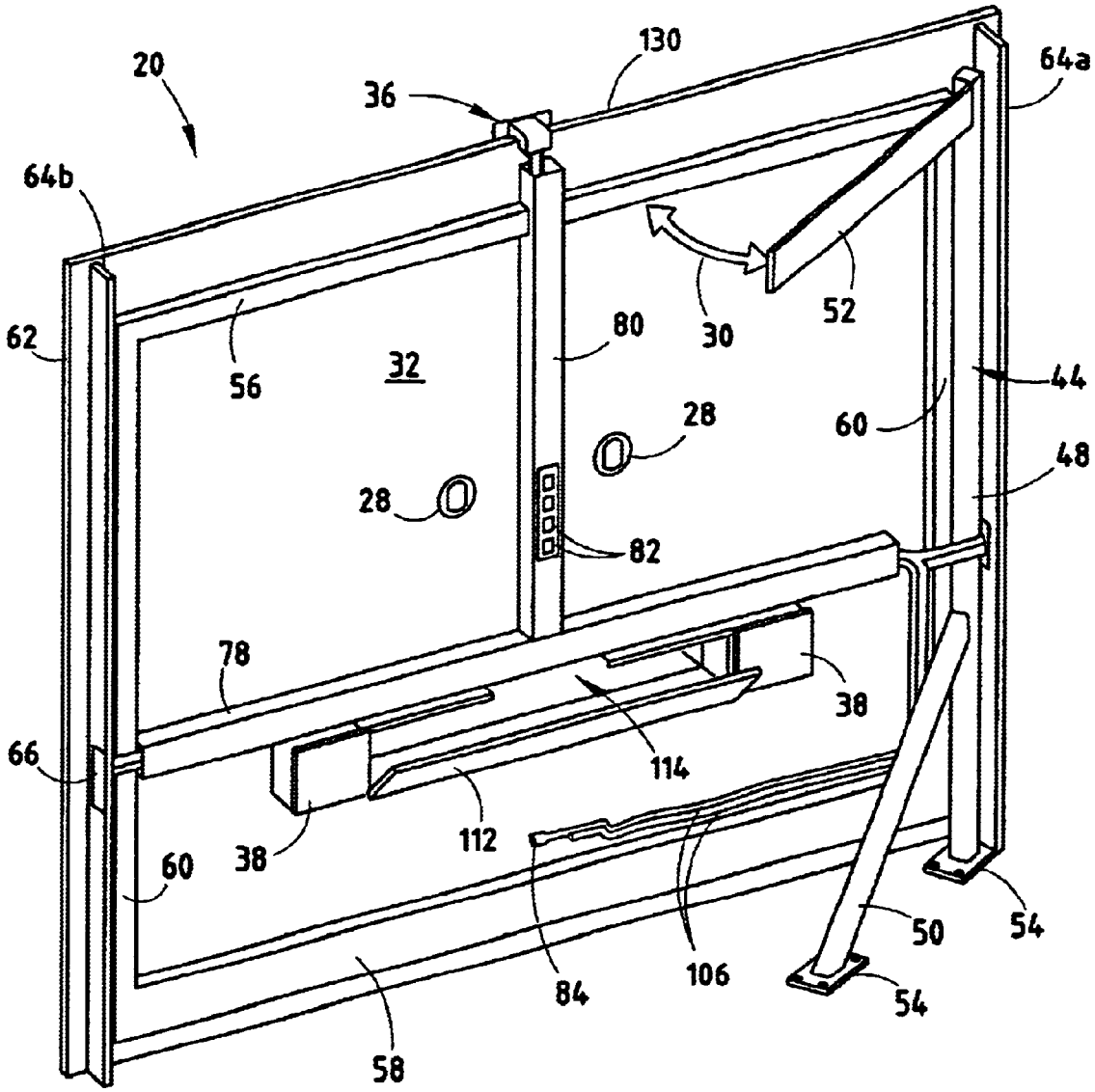
FIG. 3 is a perspective view of a back side of the media wall of FIG. 1.
Figure 4:
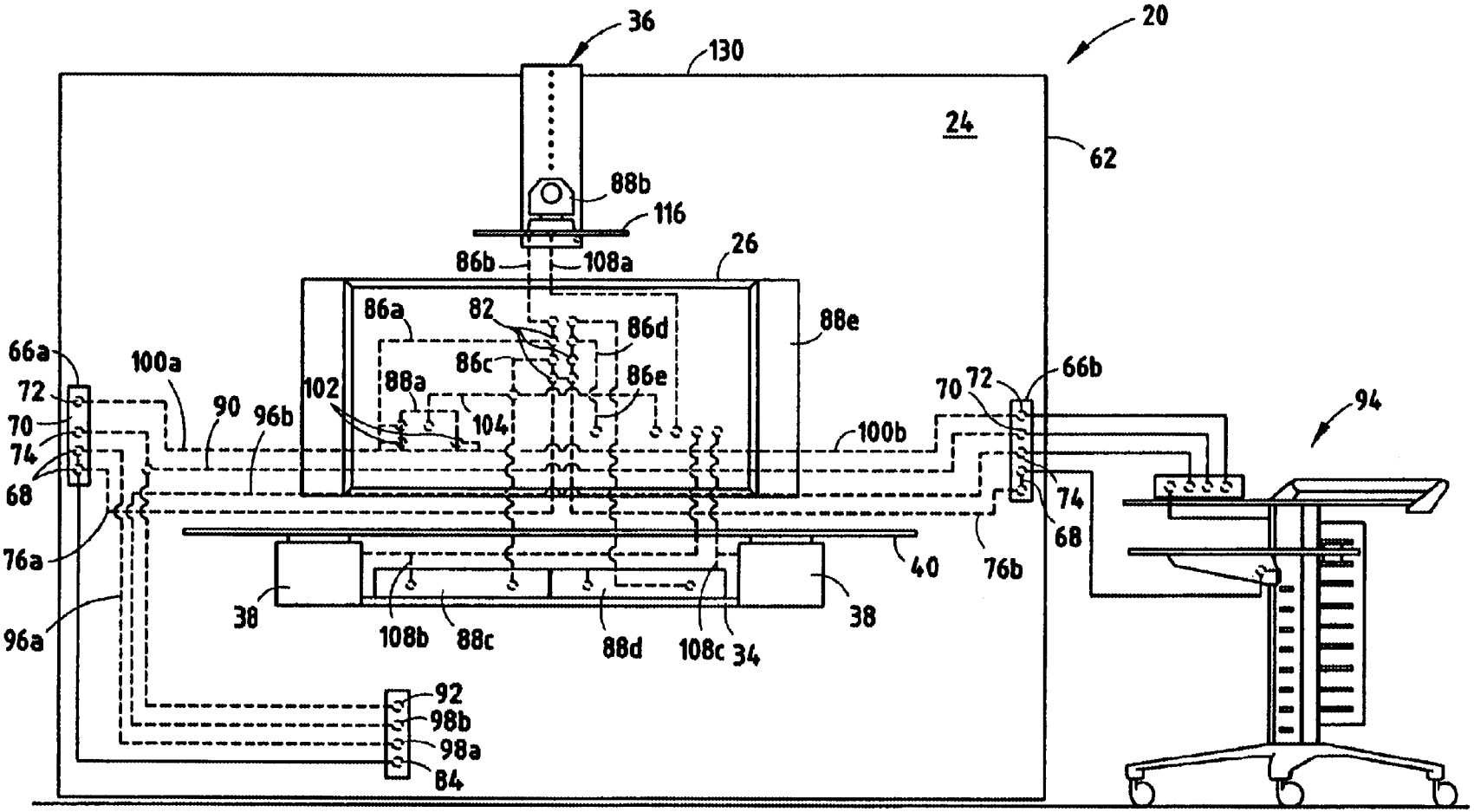
FIG. 4 is a front elevational view of a media wall including a schematic of the wiring for the media wall according to one aspect of the present invention.

A wiring diagram illustrating the wiring for media wall 20 according to one preferred embodiment is depicted in FIG. 4. A power wire 76*a* is connected to connection panel 66*a* and extends along a horizontal wire management channel 78 mounted on back face 32 of main wall 62. Power wire 76*a* extends horizontally in channel 78 to generally a midpoint of main wall 62 and then extends vertically in a vertical wire management channel 80. A power wire 76*b* is connected to connection panel 66*b* and extends along horizontal wire management channel 78 to generally the midpoint of main wall 62. From there, wire 76*b* extends vertically upward along vertical wire management channel 80, where it is electrically coupled to wire 76*a*. Power wires 76*a* and 76*b* terminate at any desired location along vertical wire management channel 80 in one or more power outlets 82 (FIG. 3). Alternatively, power wires 76*a* and *b* can terminate along horizontal wire management channel 78 in outlets 82. As yet another alternative, power wires 76*a* and *b* can be arranged to provide power outlets 82 at any desirable location or locations on back face 32. Power outlets 82 are preferably positioned such that power cords from electronic devices mounted to the front face of main wall 62 or supported on shelves 34 or 40 can be plugged into these power outlets 82 to receive power. While any number of power outlets can be used within the scope of the invention, at least four power outlets are preferably provided. Power wires 76*a* and *b* are electrically coupled to a plug 84 which can be inserted into a power outlet connected to a power source, such as a conventional power outlet in a wall, a power strip, or any other source of electrical power.

As illustrated in FIG. 4, eight power outlets 82 are provided on the back face 32 of main wall 62. Five of these power outlets 82 are electrically coupled to a plurality of electrical cords or wires 86*a–e* which supply power to a variety of electrical devices 88*a–e*. Wire 86*a* provides power to a first electrical device 88*a*, which may be a VGA automatic switcher, as will be described in more detail below. Wire 86*b* provides electrical power to device 88*b* which is positioned on video camera support 36. Device 88*b* is preferably a video camera that may be used for video-conferencing, although other types of electrical devices can be mounted on support 36. Wires 86*c* and *d* provide power to two electrical devices 88*c* and *d* located on lower shelf 34. Electrical devices 88*c* and *d* may be CD players, DVD players, VCRs, a combination of these devices, or any other type of electronic device. Wire 86*e* is connected to electronic device 88*e*, which may be a plasma screen television mounted to the front face of main wall 62, or some other type of media display device.

The location of all of the wires 86*a–e* may be varied as necessary depending upon the particular implementation of media wall 20. For example, it may be possible to position a DVD player on top of upper shelf 40, instead of lower shelf 34. Wire 86*c* would therefore extend from an outlet 82 to the back of the device on shelf 40. Each wire 86*a–e* includes a first end that is inserted into one of outlets 82 and a second end which is coupled to the particular electronic device. For DVD players, CD players, and other electrical devices, wires 86 may be permanently attached to, and a part of, the particular electronic device which is being supported on media wall 20.

A phone cable 90 is supported in horizontal wire management channel 78 and extends from the telephone jack 70 in connection panel 66*a* to the telephone jack 70 in connection panel 66*b*. Phone cable 90 is also operatively coupled to a phone plug 92, which is insertable into a standard phone jack in a wall or other device. When phone plug 92 is so inserted, a phone connection can be inserted into either or both of the telephone jacks 70 in connection panels 66*a* and *b* to thereby connect to a phone line. For example, as illustrated in FIG. 4, a laptop computer may be desirably placed on a cart 94. If the laptop includes a modem, it may be desirable to connect the laptop to a working phone line. This can be accomplished by inserting one end of a phone cable into the laptop and the other end into telephone jack 70 in connection panel. Provided telephone plug 92 is inserted into a conventional phone jack in a wall or other structure, the laptop will then have access to a phone line.

A data or network cable 96*a* is coupled between the data jack 74 in connection panel 66*a* and a data plug 98*a*. A second data or network cable 96*b* is coupled between the data jack 74 in connection panel 66*b* and a second data plug 98*b*. When data plugs 98*a* and *b* are inserted into a conventional data outlet, such as would typically be found in a structural wall of the office or residence in which media wall 20 is present, data can be transmitted to each of the respective data jacks 74. In this manner, a computer or other electronic device which requires a network connection can be plugged into one of data jacks 74. Because each data jack 74 is separately wired, two different electronic devices can access a data or network connection simultaneously, such as when one device is hooked up to the data jack 74 in connection panel 66*a* and another device is hooked up to the data jack 74 in connection panel 66*b*.

A pair of video cables 100*a* and *b* are connected respectively at one end to video jacks 72 in each connection panel 66*a* and *b*. The other end of video cables 100 are connected to video switching device 88*a*. Video switching device 88*a* may be a 2-in, 1-out VGA Auto Switcher with Loop Output, such as is sold by Altinex, Inc. of Brea, Calif., under the model number DA1916SX. Other types of video switching equipment may be substituted. Video switcher 88*a* includes two video inputs 102 and one output 104. Video switcher 88*a* automatically detects which of the two inputs 102 are currently transmitting and connects that incoming signal to the output 104. If signals are being received on both inputs 102, switcher 88*a* selects a default input to connect to output 104. Output 104 is coupled by a user to a video device, such as a plasma screen television or other device which utilizes a video connection. If media wall 20 only includes a single video jack 72, then a video switcher 88*a* is unnecessary and can be omitted from media wall 20.

While cables 86, 90, 96, and 100 are illustrated in FIG. 4 as being separate cables, they can be physically bundled together into a single cord. In FIG. 3, a pair of cables 106 are illustrated and should be understood to include a bundling of cables 86, 90, 96, and 100. Such bundling helps simplify the process for wiring the electronic devices supported on media wall 20. Horizontal and vertical wire management channels 78 and 80 help further simplify the wiring process and may, in one embodiment, be wire management channels as sold by Dek Cable Accessories, Inc. of St. Charles, Ill., under model no. 046-4030SBP. Other types of channels may also be used within the scope of the present invention to support the cabling.

In addition to the foregoing cables, video cables 108*a–c* are depicted in FIG. 3 for specific electronic devices. Cable 108*a* provides a video connection between an electronic device 88*b*, such as a video camera, and the plasma screen or other media display device 88*e*. Cables 108*b* and *c* provide video connections between the television 88*e* and each of two different electronic devices 88*c* and 88*d* on shelf 34. If additional electronic devices that utilize video signals are supported on media wall 20, additional cables would be necessary, as would be understood by one skilled in the art.

An aperture 110 is defined in main wall 62 at the back of lower shelf 34 (FIG. 3). Aperture 110 is, in the preferred embodiment, as long as shelf 34 and substantially as high as the vertical separation between lower shelf 34 and upper shelf 40. While other dimensions of aperture 110 can be used within the present invention, these dimensions are preferred in order to allow complete access to the back panels of electronic instruments positioned on shelf 34. Such complete access is preferred over smaller apertures which may not align properly with the cables coming out of the back panel of electronic devices, and which make wiring such devices more difficult due to their limited dimensions. A pivotable panel 112 is mounted adjacent the back end of shelf 34 along a horizontal axis. Pivotable panel 112 pivots between a generally upright, vertical position, and a lowered position which may be horizontal or angled. Pivotable panel 112 at least partially covers aperture 110 when it is pivoted into its upright position. Preferably a gap 114 still remains after pivotable panel 112 is pivoted to its upright position in order to provide clearance for cables extending from devices on shelf 34 to the back of main wall 62. While not necessary, gap 114 is preferably disposed adjacent a top of panel 112 as the top area is less visually accessible to passersby passing in front of media wall 20. Pivotable panel 112 thus allows easy access to be gained to the rear of shelf 34 while it is pivoted to a lowered position, and also provides aesthetically pleasing concealment of substantially all of aperture 110 while it is in its upright position.

The mounting of one or more plasma screen televisions, or other display media, on media wall 20 is accomplished through the use of a conventional plasma screen television mount. These mounts are commercially available and are secured to a desired location on front face 24 of media wall 20 by way of screws or other fasteners. Media wall 20 may or may not include apertures 28 for allowing the cables attached to the plasma screen television to be passed through main wall 62 to back face 32. If no such apertures 28 are included, then they can be drilled manually by the installer of the plasma screen television of other media display device. Leaving apertures 28 out of media wall 28 allows the user of the media wall to select any location for installing the plasma screen television on front face 24 of main wall 62 without being limited to the more aesthetically pleasing locations in which the television will conceal apertures 28. Further, different models of television may have their cables located at different positions on the television, thus making it difficult to ensure that apertures 28 are aligned with the television cables. For this additional reason, it may be desirable to omit apertures 28 from media wall 20 and allow the user to select the location for these and drill them where desired.

Figure 5:
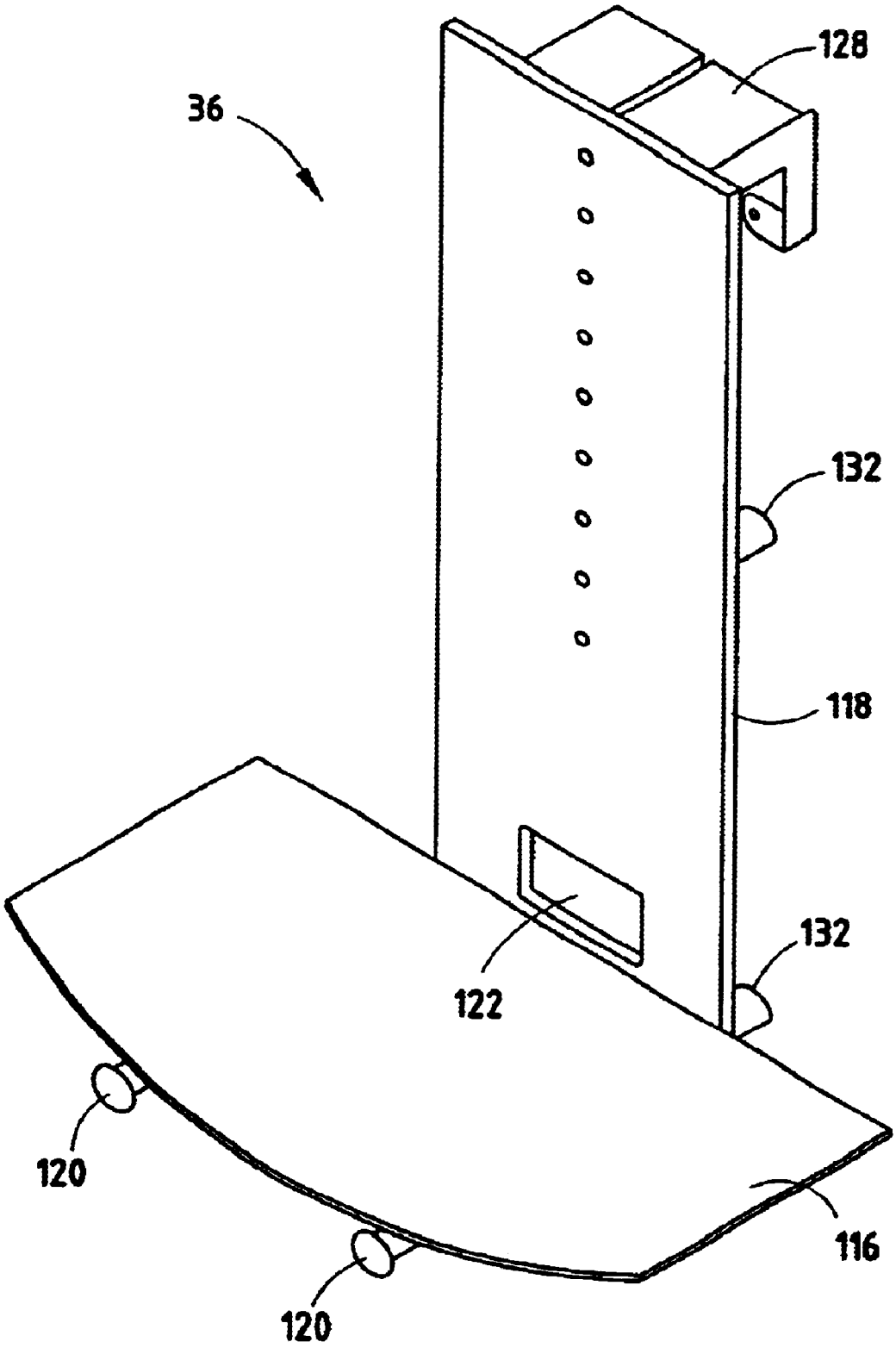
FIG. 5 is a perspective view of a video camera support according to one aspect of the present invention.
Figure 6:
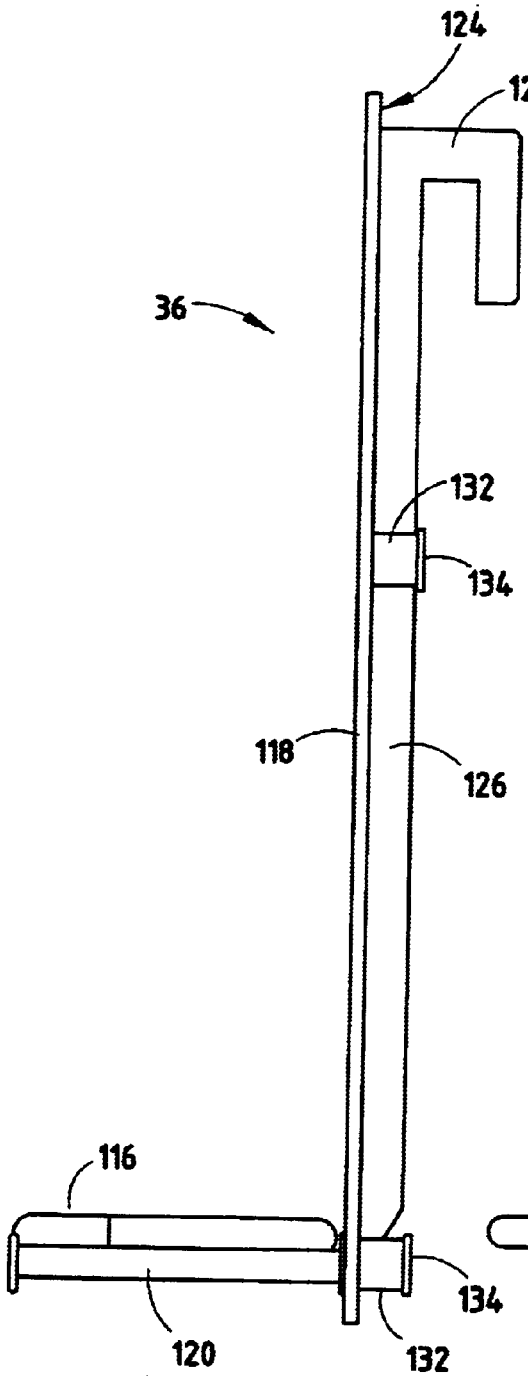
FIG. 6 is side, elevational view of the video camera support of FIG. 5.
Figure 7:
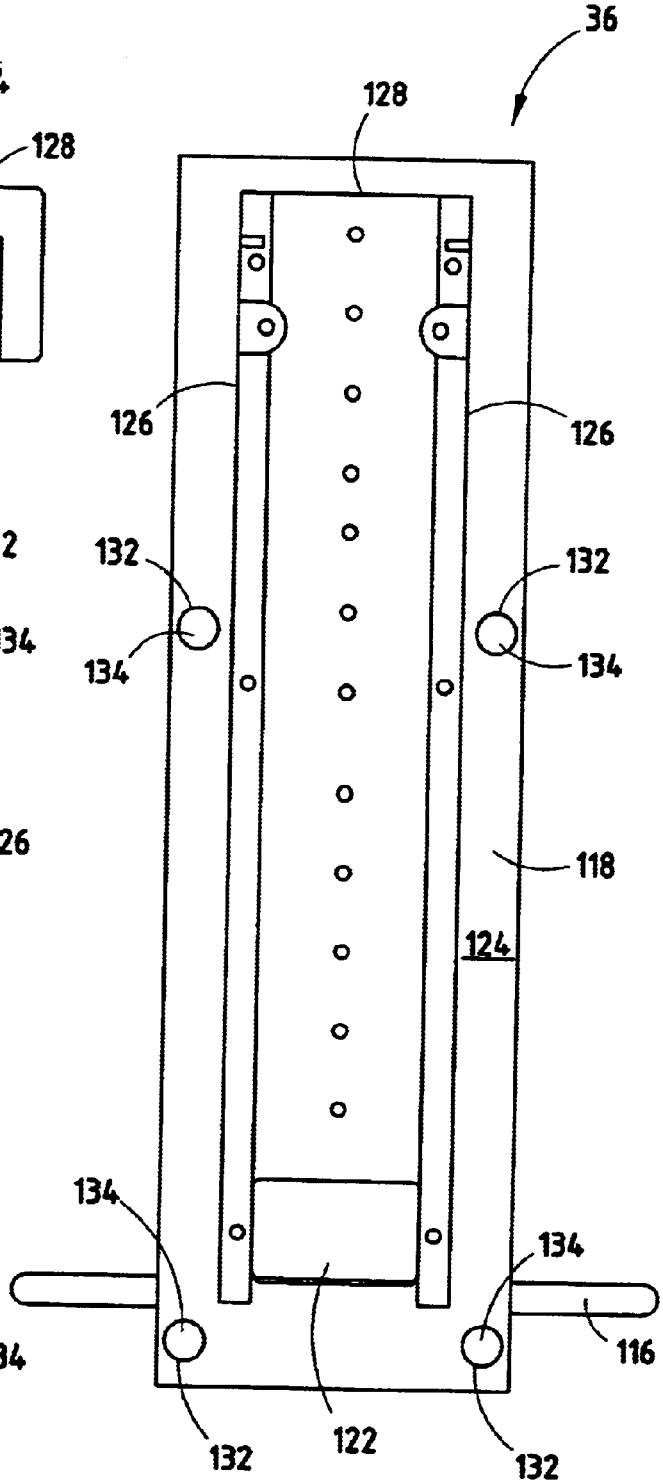
FIG. 7 is a rear, elevational view of the video camera support of FIG. 5.

Video camera support 36 may also be included as part of media wall 20. As noted, video camera support 36 can be used to support a video camera for teleconferencing, as well as supporting other devices. Video camera support 36 includes a flat shelf 116 that projects forwardly from front face 24 (FIGS. 5–7). Shelf 116 is supported on a main panel 118 by way of a pair of brackets 120. Main panel 118 includes a central aperture 122 defined generally at the height of shelf 116 and centered in main panel 118. Aperture 122 provides an opening for cords and cables which may be attached to a video camera or other electronic device supported on shelf 116. These cords or cables are preferably inserted through aperture 122 and run vertically along a back face 124 of main panel 118 until they reach the top of support 36. The cords are concealed from view by a pair of sidewalls 126 extending rearwardly a short distance from back face 124 of main panel 118. A hook 128 extends rearwardly from main panel 118 at the top of support 36 for a first distance, and then drops downwardly for a short distance. Hook 128 hooks over a top edge 130 of main wall 62 (FIG. 3) and supports video camera support 36 on main wall 62. A space for the wires or cords used with the video camera on support 36 is provided underneath hook 128. In order to conceal these wires from view, they are preferably inserted through aperture 122, run up the back face 124 of main panel 118, passed underneath hook 128 and over the top edge 130 of main wall 62, and then are either inserted into vertical wire management channel 80 or plugged into one of the outlets 82 disposed along the back side of main wall 62.

Hook 128 holds video camera support 36 on main wall 62 by gravity and therefore can be moved horizontally along the entire top edge 130 of main wall 62. A user of media wall 20 therefore has the freedom to easily adjust support 36 to any desired horizontal location on main wall 20. In order to avoid marring or otherwise damaging front face 24 of main wall 62, video camera support 36 preferable includes a plurality of pegs 132 that have a felt tipped surface 134, or other type of non-abrasive surface. Surfaces 134 contact front face 24 of main wall 62 when support 36 is used and therefore should not only be of a non-abrasive material, but should include sufficient surface area to avoid causing any indentation into front face 24 due to the weight of support 36 and the items supported thereon.

In addition to being horizontally adjustable, video camera support 36 may be altered from that depicted in the attached drawings to be vertically adjustable. While any type of vertical adjustability mechanisms are contemplated within the scope of the present invention, one such mechanism might include defining a plurality of holes in main panel 118 into which brackets 120 can be selectively inserted. Brackets 120 could then be removed and inserted into whichever of the plurality of holes was located at the desired height. Shelf 116 would then be supported on the brackets at the desired heights. If such a vertical height adjustment mechanism were used, it might be desirable to include a plurality of apertures 122 at different heights to accommodate wires at different heights. It also might be aesthetically desirable to include means for concealing such wires from being seen through apertures positioned above the aperture being used, such as by providing a channel along the side of main panel for threading the wires, or other means.

Figure 10:
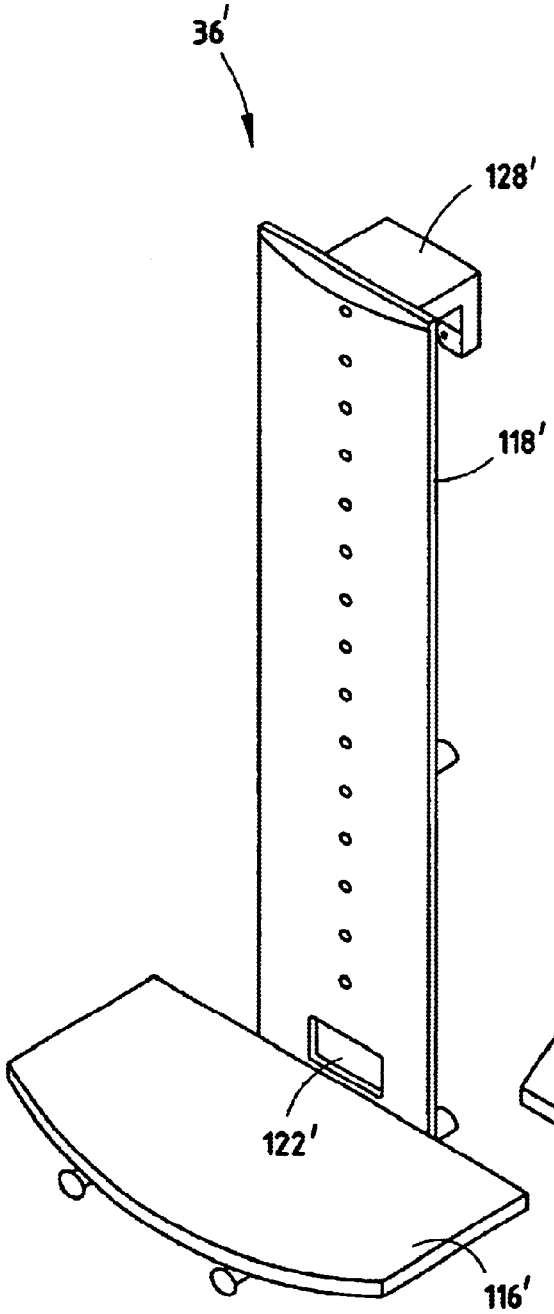
FIG. 10 is a front perspective view of a video camera support according to a second embodiment of the present invention.
Figure 11:
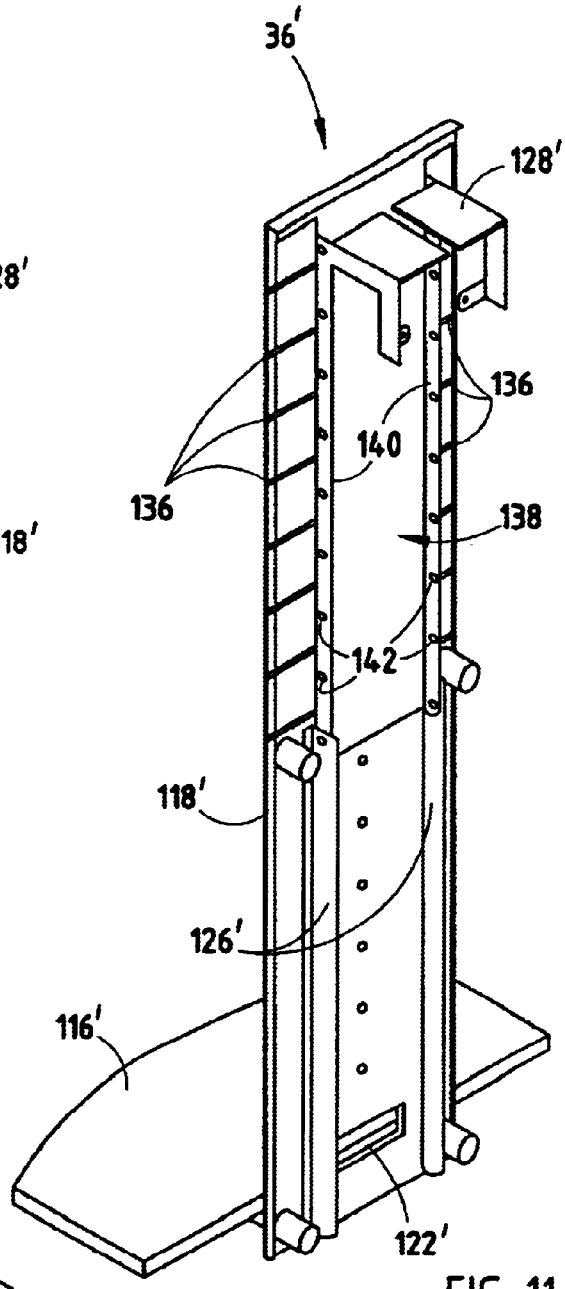
FIG. 11 is a rear perspective view of the video camera support of FIG. 10.

Another possible manner of implementing a limited form of vertical adjustability for support 36 is illustrated in FIGS. 10 and 11. Video camera support 36' depicted in these figures is adapted to have its height adjusted during its installation or during the installation of media wall 20. Once adjusted, the height can thereafter not be lengthened, but only shortened. This limited form of vertical adjustability is accomplished by way of a series of horizontal score lines 136 defined on the back of main panel 118'. These score lines allow an installer or other person to easily cut main panel 118' along a selected score line corresponding to the desired height of support 36'. The cutting of the score line is accomplished by first removing a detachable mount 138. Detachable mount 138 includes hook 128' and a pair of sidewalls 140. After detachable mount 138 has been removed, access to any of score lines 136 is obtained and the cutting can take place. After the cutting has been completed, detachable mount 138 is re-attached to support 36' by way of nuts and bolts or other fasteners inserted through the two lowermost holes in a set of holes 142 defined in sidewalls 140. These fasteners also fit through two holes defined at the top of non-detachable sidewalls 126' to thereby secure detachable mount 138 to the rest of support 36'. Thereafter, support 36' is hung via hook 128' over the top edge 130 of main wall 62. If the height of support 36' is later desired to be reduced even further, the above-described process can be repeated. It will be understood the manners of adjusting the height of support 36 and 36' are intended herein to only be illustrative, and that the present invention encompasses other types of vertical adjustability for support 36.

Figure 8:
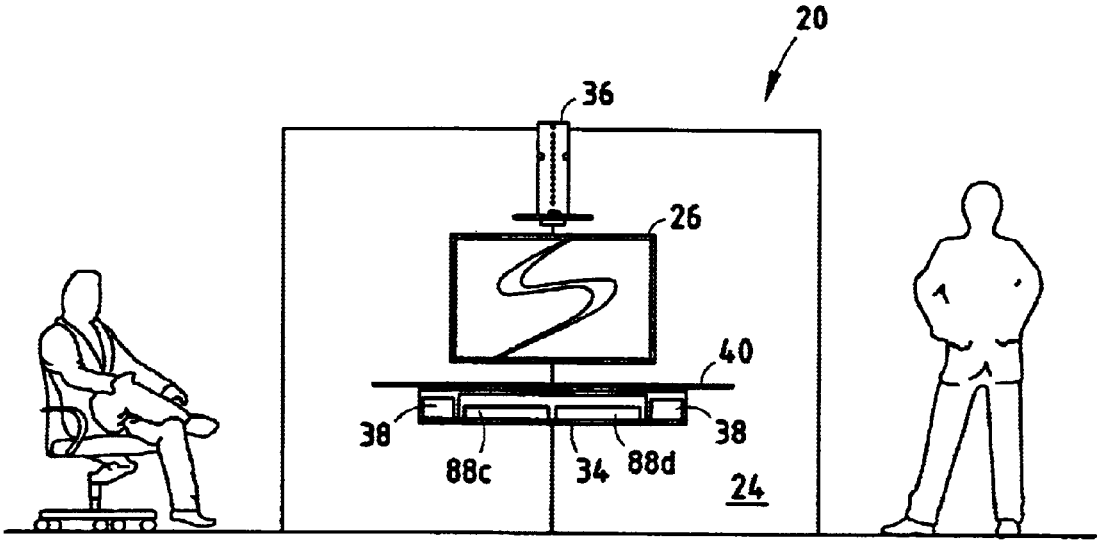
FIG. 8 is a front elevational view of a media wall illustrated with a plasma screen television attached.
Figure 9:
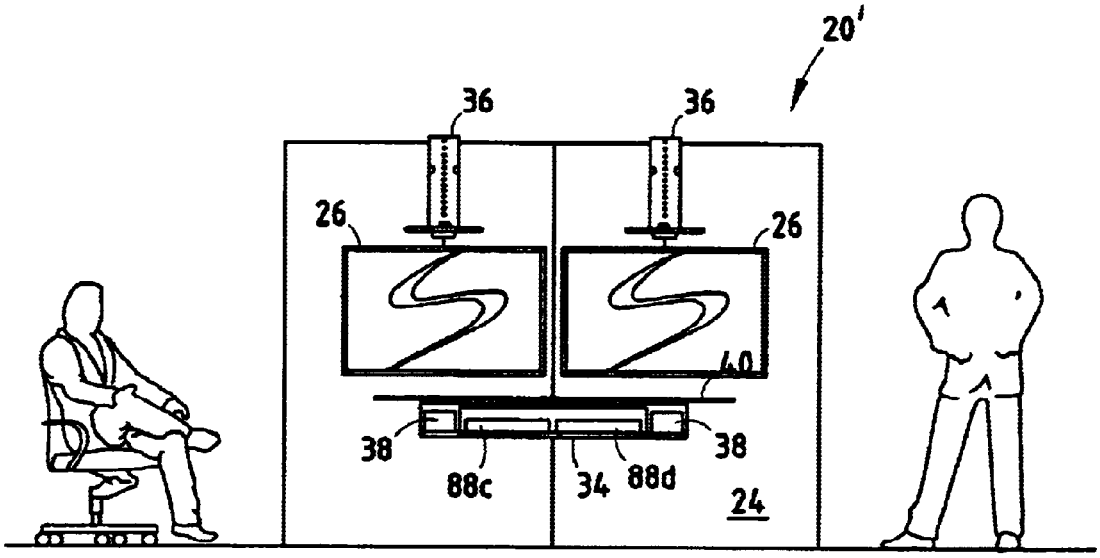
FIG. 9 is a front elevational view of a media wall according to a second embodiment of the present invention.

A number of variations can be made to the media wall 20 as described above without departing from the invention. As depicted in FIGS. 8 and 9, the height of media wall 20 can be varied as desired, although media wall 20 preferably has a height of at least five feet, although lesser heights can be used. The width of media wall 20 can also be varied as desired. More than one television can also be supported on a media wall 20', as depicted in FIG. 9, as well as more than one video camera support 34. In some instances, it may be desirable to support up to four or more televisions on the media wall. Further modifications to media wall 20 include using shapes other than rectangular or square for main wall 62; positioning shelves 34 and 40 at different locations; removing one or both of shelves 34 and 40; reshaping shelves 34 and 40; removing, reshaping, or rearranging drawers 38; and repositioning the location of connection panels 66. This list of possible modifications is only intended to be illustrative, and many further variations of media wall 20 are also contemplated within the scope of the present invention.

To install and use media wall 20, it is first brought to a desired location in a building, home, or other structure. Stationary support 44 is then secured to the floor and the wall via mounting plates 54 and top support 52. In some instances, it may not be necessary to include top support 52, depending on the weight and size of the particular media wall being used, as well as the sturdiness of the floor to which mounting plates 54 are secured. In such instances, whatever connections that are needed to firmly secure media wall 20 are made, and it is to be understood that the use of supports other than support 44 is contemplated within the invention. Support 44 may be installed while main wall 62 is attached, or it may be installed separately from main wall 62. If done separately, main wall 62 is then attached to support 44 by connecting frame 46 and support 44 together via one or more hinges.

After support 44 and main wall 62 have been firmly secured, main wall 62 is pivoted away from any adjacent structural wall, to the extent it hasn't already been so pivoted during the installation process. This pivoting allows access to the rear face 32 of main wall 62. One or more electronic devices may then be placed on shelves 34 and 40. If no apertures 28 are provided in main wall 62, these can be drilled at the desired location or locations on main wall 62 in order to accommodate wires from the plasma screen television, or other display device. The television or televisions can then be mounted using a conventional mount to the front face 24 of main wall 62. A video camera may further be placed on video camera support 34. After all the desired electronic devices are positioned on media wall 20, their respective power cords can be plugged into one or more of the power outlets 82 positioned on the back of main wall 62. The video output 104 of video switcher 88*a* is then connected by an appropriate cable to the plasma screen television in order to allow the television to display any video signals being transmitted through video jacks 72. If DVD players or VCRs are positioned on shelves 34 or 40, these can also be connected via appropriate cables to allow the television to display these signals. These connections are easily accomplished by a person standing behind media wall 20 because the entire back panel of these devices is easily accessible via the pivoting of panel 112. A video cable may further be installed between the video camera and the television to allow the television to display what the camera is viewing. Such a connection is preferably made by running the cable behind support 34, over the top edge 130 of main wall 62, and down through aperture 28 into the back of the television in order to ensure that the cable connection is not visible. After all desired cable connections have been made, the power, phone, and network plugs 82, 92, and 98 are inserted into corresponding jacks in an adjacent structural wall. Preferably, although not necessarily, media wall 20 is chosen to be installed in a location where at least one adjacent power outlet is available, as well as a phone jack and one or more network jacks. If such outlets and jacks are not located near enough to media wall 20 such that they will be concealed from view when main wall 62 is pivoted to a closed position, then it may be necessary to run extension cords or wires to insert plugs 82, 92, and 98 into the appropriate outlets or jacks. Such extensions are, of course, not aesthetically desirable.

After installation of the wires and cables is complete, main wall 62 is pivoted to a closed position (i.e. it is pivoted up against a structural wall). The pivoting of main wall 62 is facilitated by one or more wheels (not shown) positioned on the bottom of main wall 62 on a side opposite pivot axis 42. Such wheels can be made from any suitable material and can take a wide variety of designs. Preferably such wheels include a sufficient amount of surface area such that they do not leave a permanent or undue mark on the floor after main wall 62 has been pivoted, even after repeated pivotings. After main wall 62 has been closed, media wall 20 is ready for use. In addition to the normal operation of all the electronic devices supported on media wall 20, further electronic devices may be connected to media wall 20. As is shown in FIG. 4, a cart 94 is positioned adjacent media wall 20. Cart 94 may be used by a person giving a presentation to people in the room in which media wall 20 is located. If the person has a computer, such as a laptop, positioned on the cart, this computer can be connected to one of connection panels 66 on media wall 20. Such connections can include power, network, phone, or video connections. By using the video connection, it is possible for the user of the computer to transmit images on his or her computer to the television mounted on front face 24. Because connection panels 66 are preferably included on both sidewalls 64, the person giving the presentation has the freedom of working on either side of media wall 20. Alternatively, two individuals can simultaneously access connections panels 66*a* and *b* to further enhance the presentation options.

While the present invention has been described in terms of the preferred embodiments depicted in the drawings and discussed in the above specification, along with several alternative embodiments, it will be understood by one skilled in the art that the present invention is not limited to these particular embodiments, but includes any and all such modifications that are within the spirit and the scope of the present invention as defined in the appended claims.

What is claimed is:

1. A media support structure comprising:

an upright, vertical wail having a front face and a back face;

at least one sidewall attached to said back face of said wall;

at least one aperture defined in said wall and adapted to allow at least one cable to extend from said front face to said back face;

a support adapted to be affixed to a stationary structure; and a hinge attached to said support and said wall, said hinge arranged to allow said wall to pivot about a vertical axis.

2. The structure of claim 1 wherein said sidewall includes an outlet for a power connection.

3. The structure of claim 2 wherein said sidewall further includes a jack for a communications connection.

4. The structure of claim 1 further including a shelf extending forwardly from said front face of said wall.

5. The structure of claim 4 further including a conduit attached to said back face of said wall, said conduit adapted to support at least one cable for providing power to a component supported on said shelf.

6. The structure of claim 4 further including a second shelf extending forwardly from said front face of said wall.

7. The structure of claim 1 further including a video camera support mounted on said front face of said wall.

8. The structure of claim 1 further including at least one cable positioned adjacent said back face of said wall, said cable adapted to provide either electrical power or electrical communications, said cable having a first end positioned adjacent said aperture and a second end positioned adjacent a side of said wall.

9. The structure of claim 1 further including at least one drawer attached to said front face of said wall.

10. A media support structure comprising:

an upright, vertical wall having a front face and a back face;

at least one aperture defined in said wall and adapted to allow at least one cable to extend from said front face to said back face;

a support adapted to be affixed to a stationary structure;

a hinge attached to said support and said wall, said binge arranged to allow said wall to pivot about a vertical axis; and a pivotable panel supported on said wall, said panel positioned adjacent a second aperture defined in said wall and adapted to pivot between a position generally parallel to said wall and a position generally non-parallel to said wall.

11. The structure of claim 7 further including a second video camera support mounted to said front face of said wall.

12. A media support structure comprising:

an upright, vertical wall having a front face and a back face, said wall having a height of at least six feet;

at least one aperture defined in said wall and adapted to allow at least one cable to extend from said front face to said back face;

a support adapted to be affixed to a stationary structure; and a hinge attached to said support and said wall, said hinge arranged to allow said wall to pivot about a vertical axis.

13. A media support structure comprising:

an upright, vertical wall having a front face and a back face;

at least one aperture defined in said wall and adapted to allow at least one cable to extend from said front face to said back face;

a support adapted to be affixed to a stationary structure, said support being adapted to be affixed to both a floor on which said wall is placed and a building wall; and a hinge attached to said support and said wall, said hinge arranged to allow said wall to pivot about a vertical axis.

14. A media support structure comprising:

an upright, vertical wall having a front face and a back face;

at least one aperture defined in said wall and adapted to allow at least one cable to extend from said front face to said back face;

a support adapted to be affixed to a stationary structure;

a hinge attached to said support and said wall, said hinge arranged to allow said wall to pivot about a vertical axis; and a frame having a top, bottom, and two side members, said top, bottom and two side members being attached to each other and to said back face of said wall, said frame further being attached to said hinge.

15. A media support structure comprising:

an upright, vertical wall having a front face and a back face;

a first shelf attached to said front face of said wall;

a second shelf positioned below said first shelf a support adapted to be affixed to a stationary structure; and a hinge attached to said support and said wall, said hinge arranged to allow said wall to pivot about a vertical axis.

16. A media support structure comprising:

an upright, vertical wall having a front face and a back face;

at least one shelf attached to said front face of said wall;

a support adapted to be affixed to a stationary structure;

a hinge attached to said support and said wall, said hinge arranged to allow said wall to pivot about a vertical axis; and a pair of sidewalls attached to said back face of said wall.

17. The structure of claim 16 further including a video camera support mounted on said front face of said wall.

18. The structure of claim 17 wherein said video camera support is supported on a top edge of said wall and is horizontally movable along said top edge.

19. The structure of claim 17 further including a communications jack mounted on one of said sidewalls and a power outlet mounted on one of said sidewalls.

20. A media support structure comprising:

an upright vertical wall having a front face and a back face:

at least one shelf attached to said front face of said wall;

a support adapted to be affixed to a stationary structure;

a hinge attached to said support and said wall, said hinge arranged to allow said wall to pivot about a vertical axis; and a frame having a top, bottom, and two side members, said top, bottom arid two side members being attached to each other and to said back face of said wall, said frame further being attached to said hinge.

21. The structure of claim 15 further including a pair of drawers, one of said drawers positioned adjacent a first end of said second shelf and the other of said drawers positioned adjacent a second end of said second shelf.

22. The structure of claim 15 further including an aperture defined in said wall immediately above said second shelf, said aperture allowing one or more cords from electrical components positioned on said second shelf to be inserted through said aperture to said back face.

23. The structure of claim 15 further including at least one conduit mounted to said back face of said wall, said conduit adapted to support electrical cords, said conduit extending at least from a center of said wall to a side of said wall.

24. A media support structure comprising:

an upright, vertical wall having a front face and a back face;

at least one shelf attached to said front face of said wall;

a support adapted to be affixed to a stationary structure;

a hinge attached to said support and said wall, said hinge arranged to allow said wall to pivot about a vertical axis; and at least one wheel positioned along a bottom corner of said wall, said wheel being positioned adjacent a side of said wall opposite said hinge.

25. The structure of claim 10 further including at least one electrical outlet positioned in each of said pair of sidewalls.

26. A media support structure comprising:

an upright, vertical wall having a front face and a back face;

a pair of sidewalls attached to said back face of said wall, at least one shelf attached to said front face of said wall;

a support affixed to said wall and adapted to be affixed to a stationary structure such that said support secures said wall in a fixed position when affixed to a stationary structure; and at least one aperture defined in said wall and adapted to allow at least one cable to extend from said front face to said back face.

27. The structure of claim 26 further including at least one power outlet mounted on said wall adjacent said shelf, and at least one electrical cable connected to said power outlet for supplying power to said outlet, said electrical cable adapted to be connected to a power supply at an end opposite said power outlet.

28. The structure of claim 26 further including a video camera support mounted on a top edge of said wall, said video camera support being horizontally slidable along said top edge.

29. The structure of claim 26 further including at least one video port mounted on said wall adjacent said shelf, at least one video port mounted on one of said pair of sidewalls, and at least one video cable connected between said video ports, said video cable being positioned along said back face of said wall.

30. The structure of claim 26 further including a pivotable panel supported on said wall, said panel positioned adjacent a second aperture defined in said wall and adapted to pivot between a position generally parallel to said wall and a position generally non-parallel to said wall.

31. The structure of claim 26 further including a pair of drawers, one of said drawers positioned adjacent a first end of said shelf and the other of said drawers positioned adjacent a second end of said shelf.

32. The structure of claim 26 wherein said wall has a height of at least five feet.

33. The structure of claim 32 wherein said pair of sidewalls extend away from said back face of said wall no more than eight inches such that said wall can be placed adjacent and parallel to building wall by no more than eight inches.

34. A media support structure comprising:

a wall having a front face on which one or more display media may be mounted and a back face opposite said front face;

a support for maintaining said wall in a vertical, upright position;

a hinge attached to said wall and said support in a manner adapted to allow said wall to pivot about a vertical axis;

an aperture defined in said wall;

a first communications port supported by said wail;

a second communications port supported at a location adjacent said aperture; and a communications cable positioned along said back face of said wall, said communications cable having a first end electrically coupled to said first communications port, and a second end electrically coupled to said second communications port such that electrical signals can be transmitted between a first electrical device coupled to said first communications port and a second electrical device adjacent said aperture and electrically coupled to said second communications port.

35. The structure of claim 34 wherein said communications cable is a cable adapted to transmit a video signal.

36. A media support structure comprising:

a wall having a front face on which one or more display media may be mounted and a back face opposite said front face;

a support for maintaining said wall in a vertical, upright position;

an aperture defined in said wall;

a first communications port supported by said wall;

a second communications port supported at a location adjacent said aperture;

a communications cable positioned along said back face of said wall, said communications cable having a first end electrically coupled to said first communications port, and a second end electrically coupled to said second communications port such that electrical signals can be transmitted between a first electrical device coupled to said first communications port and a second electrical device adjacent said aperture and electrically coupled to said second communications port; and at least one shelf extending forwardly from said front face of said wall, said shelf being positioned adjacent said aperture.

37. A media support structure comprising:

a wall having a front face on which one or more display media may be mounted and a back face opposite said front face;

a support for maintaining said wall in a vertical, upright position;

an aperture defined in said wall;

a first communications port supported by said wall;

a second communications port supported at a location adjacent said aperture;

a communications cable positioned along said back face of said wall, said communications cable having a first end electrically coupled to said first communications port, and a second end electrically coupled to said second communications port such that electrical signals can be transmitted between a first electrical device coupled to said first communications port and a second electrical device adjacent said aperture and electrically coupled to said second communications port; and a pivotable panel positioned adjacent said aperture, said pivotable panel being pivotable to selectively cover at least a portion of said aperture.

38. The structure of claim 34 further including at least one shelf mounted to said front face of said wall.

39. The structure of claim 38 further including a pair of drawers mounted adjacent said shelf.

40. A media support structure comprising:

a wall having a front face and a back face;

a support adapted to maintain said wall in an upright, vertical position;

a shelf mounted to said front face of said wall; and at least one aperture defined in said wall above said shelf, said aperture extending from said front face to said back face, said aperture being dimensioned substantially as long as a length of said shelf and substantially as high as a back face of an electronic device intended to be supported on said shelf.

41. A media support structure comprising:

a wall having a front face and a back face;

a support adapted to maintain said wall in an upright, vertical position;

a shelf mounted to said front face of said wall;

at least one aperture defined in said wall above said shelf, said aperture extending from said front face to said back face, said aperture being dimensioned substantially as long as a length of said shelf and substantially as high as a back face of an electronic device intended to be supported on said shelf; and a pivotable panel attached to said back face of said wall adjacent said aperture such that said pivotable panel is capable of selectively being pivoted to cover at least a portion of said aperture.

42. A media support structure comprising:

a wall having a front face and a back face;

a support adapted to maintain said wall in an upright, vertical position;

a shelf mounted to said front face of said wall;

at least one aperture defined in said wall above said shelf, said aperture extending from said front face to said back face, said aperture being dimensioned substantially as long as a length of said shelf and substantially as high as a back face of an electronic device intended to be supported on said shelf; and a pivotable support on which said wall is mounted, said pivotable support adapted to allow said wall to pivot about a vertical axis.

43. A media support structure comprising:

a wall having a front face and a, back face;

a support adapted to maintain said wall in an upright, vertical position;

a shelf mounted to said front face of said wall;

at least one aperture defined in said wall above said shelf, said aperture extending from said front face to said back face, said aperture being dimensioned substantially as long as a length of said shelf and substantially as high as a back face of an electronic device intended to be supported on said shelf; and a video camera support mounted on a top edge of said wall, said video camera support being horizontally slidable along said top edge.

44. The structure of claim 40 further including an electrical communications cable connected between a location adjacent said aperture and a location adjacent a side of said wall.

45. A method of wiring at least one electronic device supported on a front face of a mounting wall comprising:

providing a generally vertical mounting wall having an aperture defined therein, said aperture extending from said front face to a back face of said mounting wall;

providing a supporting hinge for said mounting wall such that said mounting wall can be selectively pivoted about a vertical axis;

mounting said mounting wall adjacent a structural wall;

pivoting said mounting wall forwardly from said structural wall;

positioning oneself behind said mounting wall; and connecting at least one cable to the electronic device while being positioned behind the mounting wall.

46. The method of claim 45 wherein said electronic device is a plasma screen television.

47. The method of claim 45 further including providing at least one power outlet supported by said mounting wall and inserting at least one power cable from the electronic device into said power outlet.

* * * * *

UNITED STATES PATENT AND TRADEMARK OFFICE

CERTIFICATE OF CORRECTION

PATENT NO. : 6,615,551 B2
DATED : September 9, 2003
INVENTOR(S) : Linda E. Chesser et al.

It is certified that error appears in the above-identified patent and that said Letters Patent is hereby corrected as shown below:

Column 10,
Line 59, “wail” should be -- wall --

Column 11,
Line 33, “binge” should be -- hinge --

Column 12,
Line 44, “:” should be -- ; -- after “face”
Line 46, insert -- , -- after “upright”
Line 54, “arid” should be -- and --

Column 13,
Line 14, “claim10” should be -- claim16 --
Line 19, “,” should be -- ; -- after “wall”

Column 14,
Line 2, “wail” should be -- wall --

Column 16,
Line 2, delete -- , -- after “a”

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,615,551 B2
DATED : September 9, 2003
INVENTOR(S) : Linda E. Chesser et al.

It is certified that error appears in the above-identified patent and that said Letters Patent is hereby corrected as shown below:

Column 10,
Line 59, "wail" should be -- wall --

Column 11,
Line 33, "binge" should be -- hinge --

Column 12,
Line 19, insert -- ; -- after "shelf" in second occurrence
Line 43, insert -- , -- after "upright"
Line 44, ":" should be -- ; -- after "face"
Line 51, "arid" should be -- and --

Column 13,
Line 14, "claim 10" should be -- claim 16 --
Line 19, "," should be -- ; -- after "wall"

Column 14,
Line 2, "wail" should be -- wall --

Column 16,
Line 2, delete -- , -- after "a"

This certificate supersedes Certificate of Correction issued April 13, 2004.

Signed and Sealed this

Twenty-ninth Day of March, 2005

JON W. DUDAS
*Director of the United States Patent and Trademark Office*